US007314248B2

(12) United States Patent
Mabon et al.

(10) Patent No.: US 7,314,248 B2
(45) Date of Patent: Jan. 1, 2008

(54) PORTABLE WORKSTATION

(76) Inventors: Robert Alan Mabon, 309 Glen Rd., Landenberg, PA (US) 19350; Crystal Elayne Mabon, 309 Glen Rd., Landenberg, PA (US) 19350

( * ) Notice: Subject to any disclaimer, the term of this patent is extended or adjusted under 35 U.S.C. 154(b) by 0 days.

(21) Appl. No.: 11/070,555

(22) Filed: Mar. 3, 2005

(65) Prior Publication Data

US 2006/0197362 A1 Sep. 7, 2006

(51) Int. Cl.

| | |
|---|---|
| ***A47B 39/02*** | (2006.01) |
| ***A47B 39/04*** | (2006.01) |
| ***A47B 39/06*** | (2006.01) |
| ***A47B 83/02*** | (2006.01) |
| ***A47C 3/20*** | (2006.01) |

(52) U.S. Cl. ..... 297/172; 297/135; 297/152; 297/162; 297/170; 297/171; 297/174 R; 297/344.15; 297/118; 297/129

(58) Field of Classification Search ..... 297/135, 297/152, 160, 161, 162, 170, 171, 172, 174 R, 297/344.15, 118, 129

See application file for complete search history.

(56) References Cited

U.S. PATENT DOCUMENTS

| | | | | | |
|---|---|---|---|---|---|
| 249,558 | A | * | 11/1881 | Underhill | 297/344.15 X |
| 278,818 | A | * | 6/1883 | Poolman et al. | 297/344.15 |
| 367,037 | A | * | 7/1887 | Gough et al. | 297/172 |
| 387,586 | A | * | 8/1888 | French | 297/344.15 X |
| 399,069 | A | * | 3/1889 | Odell | 297/344.15 X |
| 439,857 | A | * | 11/1890 | Bartelle | 297/344.15 X |
| 585,714 | A | * | 7/1897 | Spaet | 297/170 X |
| 595,840 | A | * | 12/1897 | Washburn | 297/344.15 X |
| 612,792 | A | * | 10/1898 | Thompson | 297/344.15 X |
| 635,613 | A | * | 10/1899 | Thompson | 297/344.15 X |
| 675,186 | A | * | 5/1901 | Bacon | 297/170 |
| 689,758 | A | * | 12/1901 | Shaw | 297/170 X |
| 759,289 | A | * | 5/1904 | Leland | 297/172 X |
| 779,202 | A | * | 1/1905 | Burgess | 297/174 R X |
| 869,472 | A | * | 10/1907 | Agnew | 297/172 X |
| 968,297 | A | * | 8/1910 | Washburn | 297/344.15 |
| 993,493 | A | * | 5/1911 | Young | 297/170 X |
| 1,023,620 | A | * | 4/1912 | Burge | 297/172 X |
| 1,088,419 | A | * | 2/1914 | Heyer | 297/344.15 X |
| 1,113,140 | A | * | 10/1914 | Priest | 297/172 |
| 1,173,480 | A | * | 2/1916 | Bulik | 297/172 |
| 1,186,940 | A | * | 6/1916 | Priest | 297/172 X |
| 1,195,627 | A | * | 8/1916 | Thum | 297/172 |
| 1,209,254 | A | * | 12/1916 | Blizard | 297/172 |
| 1,213,299 | A | * | 1/1917 | Thum | 297/170 |
| 1,324,013 | A | * | 12/1919 | Sombra | 297/344.15 X |
| 1,366,274 | A | * | 1/1921 | Orth | 297/344.15 |
| 1,454,565 | A | * | 5/1923 | Sanford | 297/172 |
| 1,628,247 | A | * | 5/1927 | Jones | 297/135 |
| 1,768,427 | A | * | 6/1930 | Stevens | 297/172 X |
| 1,856,977 | A | * | 5/1932 | Swensson | 297/172 X |

(Continued)

FOREIGN PATENT DOCUMENTS

| | | | | |
|---|---|---|---|---|
| DE | 3119624 | A1 * | 12/1982 | 297/171 |

(Continued)

*Primary Examiner*—Rodney B. White

(57) ABSTRACT

A portable workstation apparatus having a collapsible frame, wheels, a seat, and work surface, whereby collapsing the frame and manipulating an articulated work surface attachment, permits the apparatus to be utilized as a hand truck. Also described is an enhanced version of the collapsible portable workstation apparatus having a scissors linkage lift mechanism allowing adjustment of the seating height.

34 Claims, 8 Drawing Sheets

NOTE: NOT TO SCALE

NOTE: NOT TO SCALE

U.S. PATENT DOCUMENTS 1,883,322 A * 10/1932 Abbott ..... 297/172 X
1,884,497 A * 10/1932 Abbott ..... 297/172 X
1,929,551 A * 10/1933 Hamilton ..... 297/172 X
1,970,874 A * 8/1934 Yawman ..... 297/172
1,971,926 A * 8/1934 Weakley et al. ..... 297/174 R
2,023,761 A * 12/1935 Drummey ..... 297/172
2,115,497 A * 4/1938 Mintz ..... 297/172 X
2,168,910 A * 8/1939 Merrill ..... 297/172
2,287,614 A * 6/1942 Hawkins ..... 297/171 X
2,375,696 A * 5/1945 Shick ..... 297/174 R X
2,579,606 A * 12/1951 Oom et al. ..... 297/174 R
2,592,025 A * 4/1952 Gray ..... 297/344.15
2,664,147 A * 12/1953 O'Keefe et al. ..... 297/172
2,710,051 A * 6/1955 Greenberg ..... 297/170 X
2,716,440 A * 8/1955 Silverman ..... 297/172
2,725,095 A * 11/1955 Rodefeld ..... 297/170
2,732,007 A * 1/1956 MacWhirter ..... 297/172
D176,881 S * 2/1956 Phillips ..... 297/170 X
2,821,242 A * 1/1958 Manegold ..... 297/344.15 X
2,982,336 A * 5/1961 Minici ..... 297/344.15 X
3,034,827 A * 5/1962 Rassier ..... 297/170
3,073,614 A * 1/1963 Zinneman ..... 297/129 X
3,127,170 A * 3/1964 Caster ..... 297/135 X
3,206,775 A * 9/1965 Filson ..... 297/174 R
3,244,450 A * 4/1966 Boutin ..... 297/172 X
3,285,654 A * 11/1966 Cramer ..... 297/129 X
3,420,571 A * 1/1969 Moore ..... 297/135 X
3,599,962 A * 8/1971 Henry ..... 297/172 X
3,758,128 A * 9/1973 Stenwall ..... 297/129 X
3,917,210 A * 11/1975 Miller ..... 297/344.15 X
3,997,213 A * 12/1976 Smith et al. ..... 297/118
4,067,606 A * 1/1978 Desmoulins nee Fouchereau et al. ..... 297/170 X
4,134,614 A * 1/1979 Fielding, Sr. ..... 297/172 X
4,289,350 A * 9/1981 Thomas et al. ..... 297/172
4,290,625 A * 9/1981 Barriere ..... 297/129 X
4,300,798 A * 11/1981 Musgrove et al. ..... 297/162 X
4,394,046 A * 7/1983 Irwin et al. ..... 297/344.15 X
4,482,185 A * 11/1984 Zoellner ..... 297/135
4,632,410 A * 12/1986 Bainbridge et al. ..... 297/172 X
4,645,262 A * 2/1987 Furubotten ..... 297/129
4,659,142 A * 4/1987 Kuchinsky, Jr. ..... 297/118
4,703,944 A * 11/1987 Higson ..... 297/129 X
4,733,905 A * 3/1988 Buickerood et al. ..... 297/129
4,749,209 A * 6/1988 Edmonds ..... 297/118 X
4,767,159 A * 8/1988 Opsvik ..... 297/172 X
4,798,411 A * 1/1989 Lin ..... 297/170
4,824,167 A * 4/1989 King ..... 297/129
4,892,352 A * 1/1990 Haywood ..... 297/174 R X
4,921,302 A * 5/1990 Godwin ..... 297/170
5,062,650 A * 11/1991 Chang ..... 297/129
5,160,182 A * 11/1992 Chang ..... 297/129
5,161,766 A * 11/1992 Arima ..... 297/174 R
5,169,210 A * 12/1992 Fricano ..... 297/170 X
5,330,253 A * 7/1994 Kaneko ..... 297/344.15
5,356,160 A * 10/1994 Urlwin ..... 297/129 X
5,356,197 A * 10/1994 Simic ..... 297/129
5,413,400 A 5/1995 Llanes
5,423,592 A * 6/1995 Spurrier et al. ..... 297/129
5,474,356 A * 12/1995 Johnson ..... 297/174 R X
5,542,740 A * 8/1996 Chang ..... 297/129
5,542,746 A * 8/1996 Bujaryn ..... 297/172 X
5,653,499 A * 8/1997 Goodall ..... 297/170
5,685,602 A * 11/1997 Williams ..... 297/174 R
5,697,668 A * 12/1997 Chao ..... 297/172
5,711,572 A * 1/1998 Khan ..... 297/174 R X
5,800,016 A * 9/1998 Allred ..... 297/344.15 X
5,876,093 A * 3/1999 Williams ..... 297/174 R
5,884,966 A * 3/1999 Hill et al. ..... 297/170
5,893,607 A * 4/1999 Trimnell ..... 297/170
5,961,134 A 10/1999 Congleton et al.
5,961,179 A * 10/1999 Dixon et al. ..... 297/174 R X
5,988,738 A * 11/1999 Blessing et al. ..... 297/174 R X
6,033,014 A * 3/2000 Nightengale ..... 297/174 R
6,039,392 A * 3/2000 Dencker ..... 297/172
6,057,659 A * 5/2000 Akiyama et al. ..... 297/174 R
6,079,777 A * 6/2000 Simmons et al. ..... 297/129 X
6,098,936 A 8/2000 Birrell
6,312,048 B1 * 11/2001 Kilmer ..... 297/129
6,354,657 B1 * 3/2002 Nelson et al. ..... 297/129 X
6,375,200 B1 * 4/2002 Harter ..... 297/129 X
6,439,134 B1 8/2002 Ryburg
6,543,796 B1 4/2003 Johnson et al.
6,565,112 B2 * 5/2003 Hanson et al. ..... 297/344.15 X
6,601,865 B1 * 8/2003 Harper ..... 297/162 X
6,604,720 B1 8/2003 Wilson
6,604,783 B2 8/2003 Goodson
6,676,208 B2 * 1/2004 Lu ..... 297/170 X
6,776,452 B2 * 8/2004 Onishi ..... 297/170
6,953,222 B2 * 10/2005 Larrick et al. ..... 297/172
2003/0222486 A1 * 12/2003 Lu ..... 297/135
2006/0103177 A1 * 5/2006 Vergara et al. ..... 297/170 X

FOREIGN PATENT DOCUMENTS

EP 252274 A2 * 1/1988 ..... 297/152
EP 560256 A1 * 9/1993 ..... 297/344.15
JP 58199231 A * 11/1983 ..... 297/344.15

* cited by examiner

NOTE: NOT TO SCALE

NOTE: NOT TO SCALE

NOTE: NOT TO SCALE

NOTE: NOT TO SCALE

NOTE: NOT TO SCALE

NOTE: NOT TO SCALE

NOTE: NOT TO SCALE

NOTE: NOT TO SCALE

PORTABLE WORKSTATION

FIELD OF THE INVENTION

This invention generally relates to seats, desks, tables, workstations, and hand trucks. Specifically, this device is a combination folding portable seat/desk/hand truck.

BACKGROUND OF THE INVENTION

Traditionally, technicians, engineers, surveyors, maintenance, and emergency personnel and the like employed in industrial, commercial or institutional settings are required to perform field work outside a typical office environment. Field work may be indoors or outdoors, upon a factory floor or mezzanine, aboard a seagoing vessel, aircraft or land vehicle. Field work generally involves equipment and or facilities construction, start-up, commissioning, field trials, maintenance, calibration, certification etc. Such field work can range from a few minutes duration to days or even years dependant on the project work scope. Many field work sites do not have permanent workstations, tables, desks, chairs, and or hand trucks hereafter known as workstations. Generally it is not practical to locate permanent workstations that will be used infrequently as the workstations occupy expensive real estate and typically collect useless items rendering the workstations unavailable when needed. Oftentimes makeshift workstations are assembled from inverted buckets, wire spools, boxes, crates, pallets, steps, machinery ledges, etc. Rarely are these makeshift workstations the correct seating or working height and as such are generally uncomfortable. Fatigue commonly occurs when using such makeshift workstations resulting in reduced productivity and workmanship. Additionally, makeshift workstations are often unstable and or incapable of adequately supporting personnel or equipment. Personnel injury and or equipment damage can and does occur due to workstation tipping and or structural failure.

Frequently, heavy toolboxes, briefcases, portable computers, instruments, etc. hereafter known as equipment, are hand carried to the field work site. Injuries such as muscle strains, back pain, etc. are commonly related to lifting or hand carrying equipment.

Hand trucks provide an injury reducing means to transport equipment to work sites, but do not provide a seat or work surface.

Overall, makeshift workstations are generally inadequate in the following respects:

1. Seating position (horizontal and vertical) relative to work surface
2. Seating comfort (non ergonomic design)
3. Work surface position (horizontal and vertical) relative to seating
4. Work surface horizontal tilt relative to seating
5. Stability (seating and work surface)
6. Load capacity (personnel and instruments)
7. Provide no means to transport equipment

PRIOR ART

The proposed device differs from U.S. Pat. No. 6,601,865 Visually Appealing Versatile Rollable and Folding Chair as the prior art provides portable seating and a reading surface, but the four wheel design is inherently unstable on uneven flooring. Additionally, the seating height and book surface height are generally not readily adjustable to accommodate the majority of the world's adult population.

The proposed device differs from U.S. Pat. No. 6,439,134 Work Surface for Luggage and Luggage Carriers as the prior art provides a portable a work surface and luggage carrier but no seating means.

The proposed device differs from U.S. Pat. No. 6,604,720 Portable PC Workstation as the prior art provides a portable work surface but no seating means.

The proposed device differs from U.S. Pat. No. 6,543,796 Combined Desk and Luggage Carrier as the prior art provides a portable work surface and luggage carrier but no seating means.

The proposed device differs from U.S. Pat. No. 5,413,400 Portable Desk Assembly as the prior art provides portable seating and a work surface but without the means transport itself via wheels or transport additional equipment.

The proposed device differs from U.S. Pat. No. 6,604,783 B2 Portable Collapsible Workstation as the prior art provides portable seating and a work surface but without the means transport itself via wheels or transport additional equipment.

The proposed device differs from U.S. Pat. No. 5,961,134 Apparatus for Housing and Transporting, and Furnishing an Adjustable User-platform for a Portable Computer as the prior art provides portable work surface and transportation means, but no seating means.

The proposed device differs from U.S. Pat. No. 6,098,936 Portable Ergonomic Work Station as the prior art provides portable work surface, but no seating means.

The proposed device provides a portable workstation solving the aforementioned limitations by providing the following features:

1. Means for providing portability including:
   a. Device folds to facilitate device portability
   b. Device provides wheels to facilitate device portability
   c. Device provides handle assembly to facilitate device portability
   d. Device serves as a hand truck to facilitate equipment portability
   e. Device provides lifting device to facilitate device portability
2. Means for supporting personnel including:
   a. Device provides seating assembly
   b. Seating assembly adjustable about vertical axis, accommodating 95% of world adult population
   c. Seating assembly rotates about vertical axis
   d. Seating is ergonomically designed, accommodating 95% of world adult population
3. Means for supporting work equipment including:
   a. Device provides work surface assembly
   b. Work surface assembly is adjustable about the vertical and horizontal planes, accommodating 95% of world adult population
   c. Work surface assembly adjustability with respect to seating assembly accommodates 95% of world adult population
   d. Work surface can function as an easel, poster holder, or other media holder
   e. Work surface can be replaced with greater area work surfaces
   f. Work surface can be replaced with equipment such as photographic equipment 4. Miscellaneous features:
   a. Tripod frame design provides stability on most surfaces
   b. Multiple workstations can be combined across, side by side or any combination thereof to provide increased work surface area and common work surface area seating
   c. Materials of construction and construction features selected for various environmental service or environmental conditions, including but not limited to:
      1. National Sanitary Foundation (NSF) food service
      2. Chemical, temperature, biological resistance
      3. Classified/hazardous locations as per National Fire Protection Association (NFPA 70) National Electrical Code
      4. Electrically insulated
      5. Electrically conductive and static dissipative
   d. Mechanical attachment means to prevent unwanted workstation motion or removal
   e. Vibration damping components can be provided
   f. Tie down means for transporting equipment

SUMMARY OF THE INVENTION

This invention provides a portable workstation apparatus and method designed to satisfy the aforementioned needs. The invention is a wheeled, portable, collapsible workstation with integral seating, work surface, load securing and transportation capacity. This unique invention utilizes a stable tripod frame structure, an ergonomically adjustable and designed seating assembly, and an ergonomically adjustable and designed work surface assembly in a hand portable device. The invention is designed to accommodate approximately the workstation dimensional requirements of 95% of the world's adult population (smallest 2.5% to largest 97.5%). With commonly used construction materials, and fabrication techniques similar to bicycle manufacturing; the invention provides a simple and economic portable workstation solution for engineers, technicians, maintenance personnel, and the like employed in such professions.

The workstation work surface provides a storage location and attachment means for equipment, luggage, toolboxes, instrumentation, computing devices, and the like. The user attaches equipment to the work surface. Using the integral handle and wheels, the user pulls/pushes the workstation and equipment to a work site. The user removes the equipment from the work surface, and unfolds the workstation, adjusting the seat and work surface as desired. The user replaces the equipment on the work surface. The user now has an ergonomically adjusted workstation allowing for greater productivity and less fatigue. Additionally, equipment damage due to falls from unstable or makeshift work surfaces is minimized. Variations in construction materials provide for increased resistance to damage from the elements, chemical or physical abuse, food service or use in hazardous/classified locations. Various equipment devices such as photographic equipment may be substituted for the work surface. Additionally, the work surface converts to an artist's easel. Two or more workstations may be combined forming a larger table work surface.

DESCRIPTION OF THE PREFERRED EMBODIMENT

Figure 1:
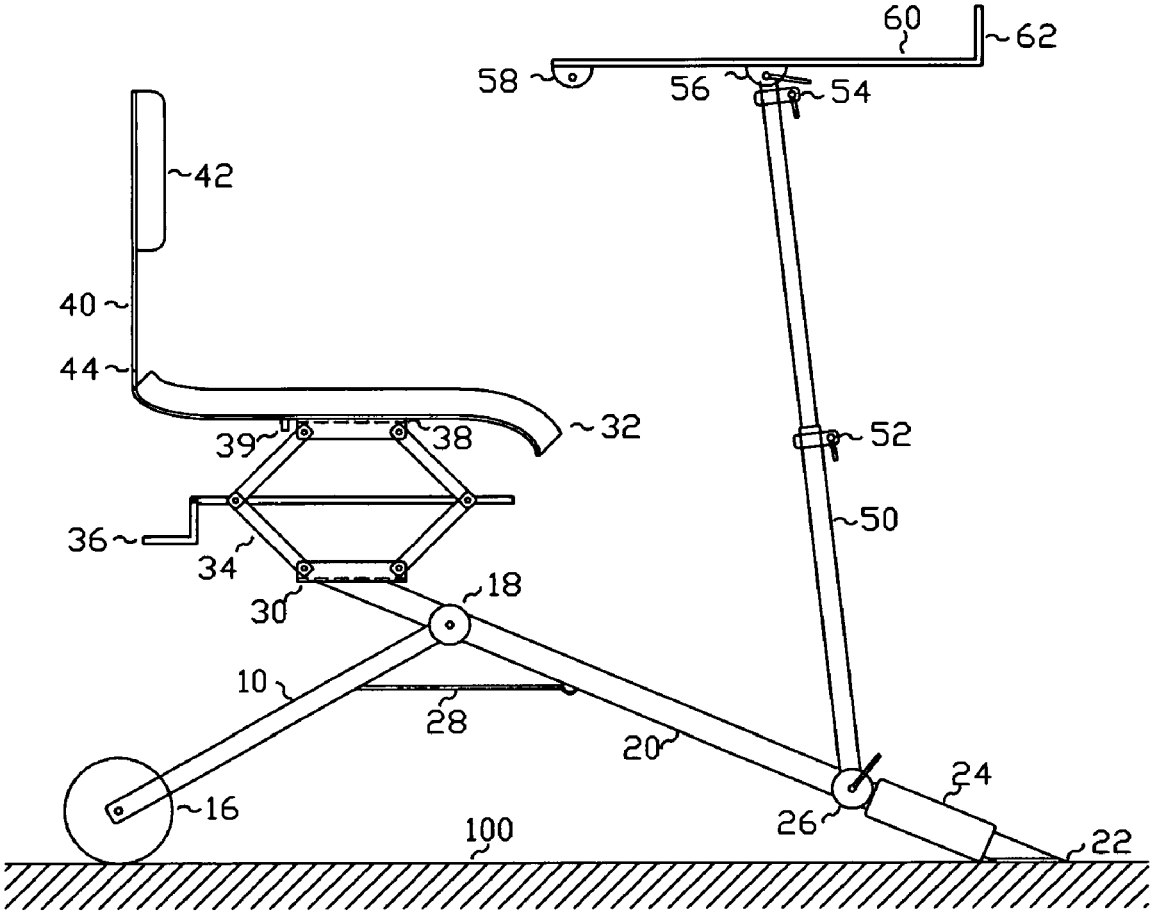
FIG. 1 is a side view of the portable workstation apparatus configured for the average $50^{th}$ percentile user configuration.

FIG. 1 is a side view of the portable workstation apparatus configured for the average or $50^{th}$ percentile user configuration. The workstation is comprised of an articulated and collapsible tripod frame assembly hereafter known as the Frame. Item 10 is first frame subassembly hereafter known as Frame 10, further detailed in FIG. 7. Item 10 essentially forms two legs of the tripod frame assembly. Item 20 is a beam type second frame subassembly, hereafter known as Frame 20, forming the third leg of the articulated and collapsible tripod frame assembly. Item 18 is a lockable articulated joint hereafter known as Joint 18, combining Frame 10 and Frame 20 into an articulated and collapsible tripod frame assembly. Joint 18 can have lockable means within its own assembly in the form of a ratcheting mechanism or a clamping mechanism. Alternately, the locking mechanism for joint 18 may be facilitated by support member 28, holding the Frame in an upright and operating position. Support member 28 is detachable from either or both Frame 10 or Frame 20, positioning the Frame in a collapsed transport and storage position. Wheels 16 attached to Frame 10 provide means to transport the workstation apparatus about the floor 100. The wheels 16 are dimensioned to provide rolling ease, and use upon common industrial traffic floor gratings. Alternately, the wheels 16 can be lockable to inhibit unintended motion. A skid plate 22 is provided to inhibit unintended motion. Additionally, the skid plate is dimensioned such that is suitable for use upon common industrial traffic floor gratings. Any or all of the wheels 16 may be replaced with a skid plate 22. The skid plate 22 also provides a hole formed within as a means to permanently affix the workstation to inhibit unintended motion. Both the wheels 16 and the skid plate 22 may provide leveling means, vibration damping, and or resistance to environmental factors such as but not limited to temperature, chemicals, etc. A handle 24 is formed within or attached to Frame 20 as a means for the user to grasp and transport the workstation.

A seat assembly mounting device 30 hereafter known as Mount 30 is generally attached to Frame 20. A seat vertical position control device 34 hereafter known as Lift 34 is attached to Mount 30. A scissors linkage lifting mechanism is preferred for lift 34 as it is compact and provides a raised to lowered height ratio greater than 2:1. Bellows type pinch point guarding and or aesthetic covering(s) although not shown, may be employed to cover Lift 34. Lift 34 is actuated via handle 36. Handle 36 is articulated such that it will pivot and release should it catch upon an obstacle while the apparatus is transported. A bearing assembly 38 may be provided to allow the user to swivel the seat 32. The bearing assembly 38 can be constructed of sliding and or rolling bearing materials, with the choice of material being suitable for the workstation environment. A stop mechanism 39, generally a releasable spring type plunger device, can be used to prevent seat 32 rotation about the vertical axis. The seat 32 dimensions and features are configured to support 95% of the world's adult population. The seat 32 can be provided with a removable back support member 40. The back support member 40 may have an articulation 44 to facilitate storage and transportation. A seat back 42 is provided upon the back support member 40. An approximate planar work surface 60 is supported via a work surface position control device 50 hereafter known as Position Control 50. Position Control 50 generally consists of one or more extensible members with extension locking points 52 and if necessary 54. Position Control 50 also cooperates with Frame 20 via a lockable articulation 26. Lockable articulation 26 can have lockable means within its own assembly in the form of a ratcheting mechanism or a clamping mechanism. Position Control 50 also cooperates with work surface 60 via a lockable articulation 56. Lockable articulation 56 can have lockable means within its own assembly in the form of a ratcheting mechanism or a clamping mechanism. Work surface 60 is provided having one or more attachment areas for lockable articulation 56 cooperation with position control 50. Position control 50 extensible features cooperating with lockable articulation 26 and lockable articulation 56, provides means of horizontal and vertical positioning of work surface 60 with respect to seat 32. Said cooperation between seat 32 to work surface 60, providing dimensional accommodations for 50% of world adult population. The positioning of seat 32 and work surface 60 are consistent with the needs of the average or $50^{th}$ percentile user. Alternate point of lockable articulation 58 is provided for alternative configurations described in FIGS. 4, 5, and 6.

Figure 2:
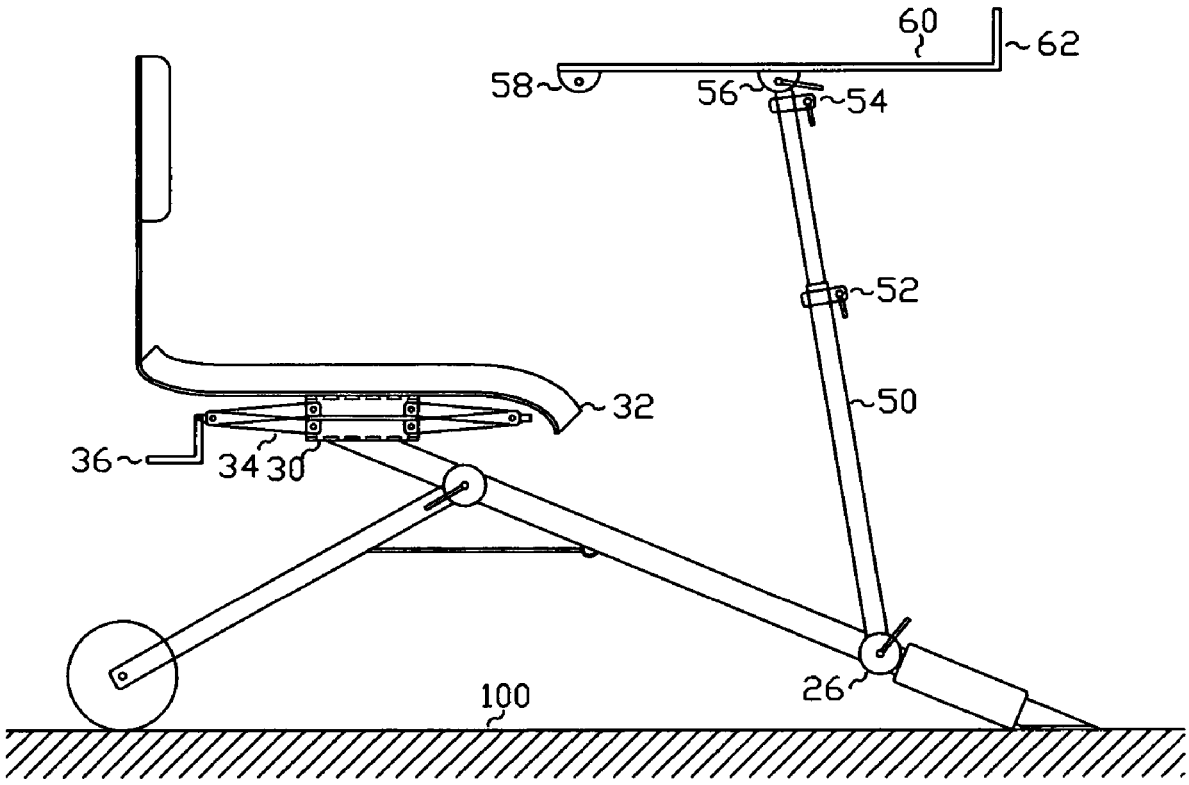
FIG. 2 is a side view of the portable workstation apparatus configured for the smallest $2.5^{th}$ percentile user configuration.

FIG. 2 is a side view of the portable workstation apparatus configured for the smallest or 2.5 percentile user configuration. All the components recited in the description of FIG. 1 are utilized with the following modifications: The position of seat 32 is adjusted via Lift 34 and Handle 32, the position of work surface 60 is adjusted via Position Control 50, lockable articulation 26, and lockable articulation 56, accommodating the needs of the smallest or 2.5 percentile user configuration.

Figure 3:
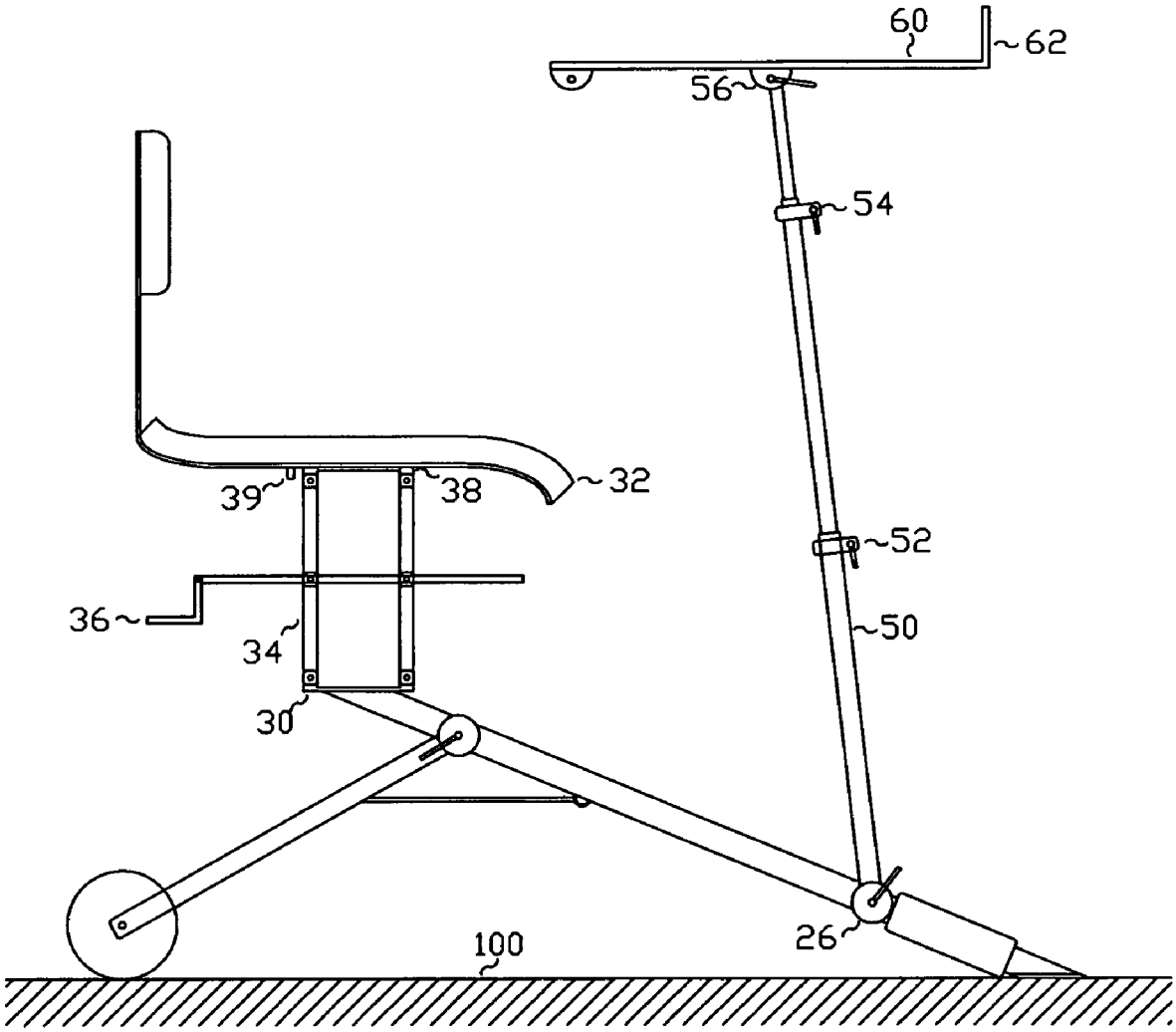
FIG. 3 is a side view of the portable workstation apparatus configured for the average $97.5^{th}$ percentile user configuration.

FIG. 3 is a side view of the portable workstation apparatus configured for the largest or $95^{th}$ percentile user configuration. All the components recited in the description of FIG. 1 are utilized with the following modifications: The position of seat 32 is adjusted via Lift 34 and Handle 32, the position of work surface 60 is adjusted via position control 50, lockable articulation 26, and lockable articulation 56, accommodating the needs of the largest or $95^{th}$ percentile user configuration.

Figure 4:
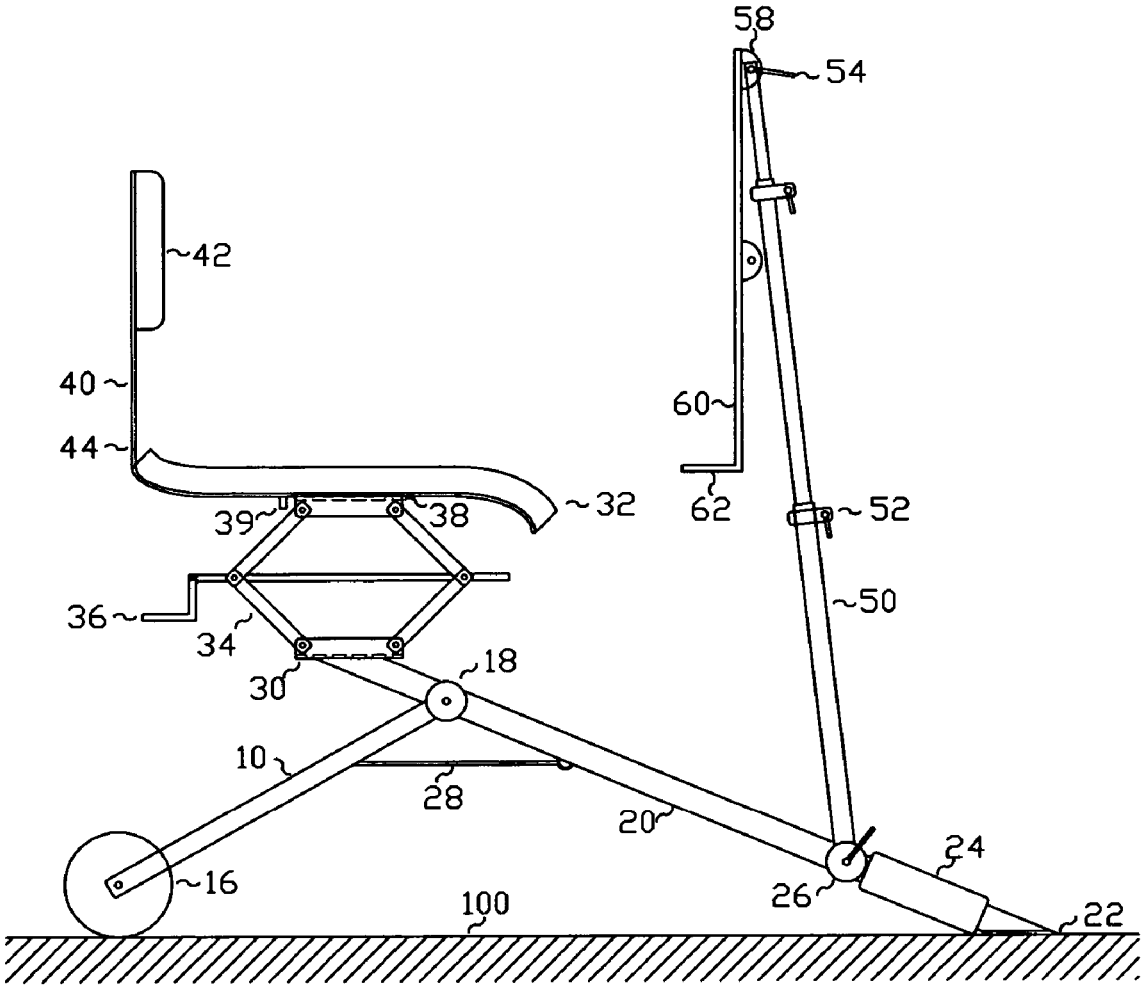
FIG. 4 is a side view of the portable workstation apparatus configured for an artist's easel configuration.

FIG. 4 is a side view of the portable workstation apparatus configured for an artist's easel user configuration. All the components recited in the description of FIG. 1 are utilized with the following modifications: The position of work surface 60 is changed and lockable articulation 58 is utilized, an articulated fork truck nose 62 is rigidly held at substantially a right angle to the work surface 60, accommodating the needs of supporting an artist's easel user configuration.

Figure 5:
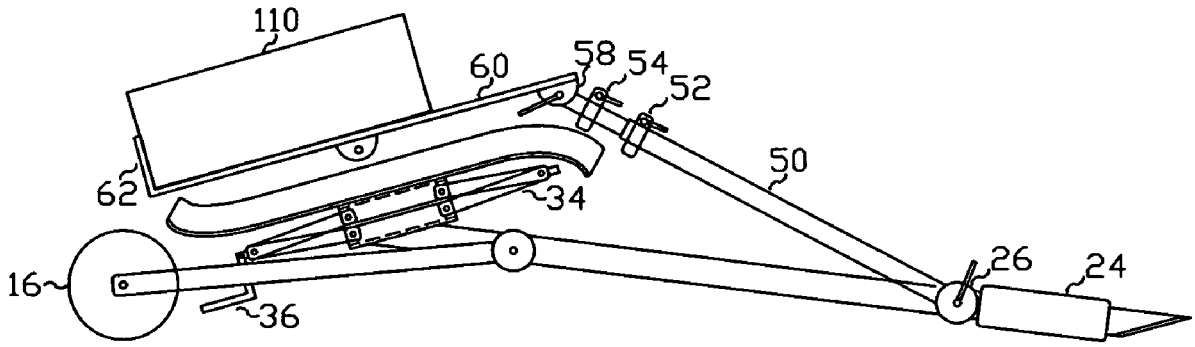
FIG. 5 is a side view of the portable workstation apparatus collapsed for transport configuration.

FIG. 5 is a side view of the portable workstation apparatus for transport configuration with equipment. All the components recited in the description of FIG. 4 are utilized with the following modifications: The position of seat 32 is adjusted via Lift 34 and Handle 32 to its lowest operative position. The position of work surface 60 is adjusted via position control 50, lockable articulation 26, and lockable articulation 58. The locking mechanism for joint 18 is released positioning the frame in a collapsed transport and storage position. Wheels 16 and Handle 24 provide means to transport the collapsed workstation and apparatus about the floor 100. The articulated fork truck nose 62 is rigidly held at substantially a right angle to the work surface 60. Equipment 110 is positioned on work surface 60 for transportation.

Figure 6:
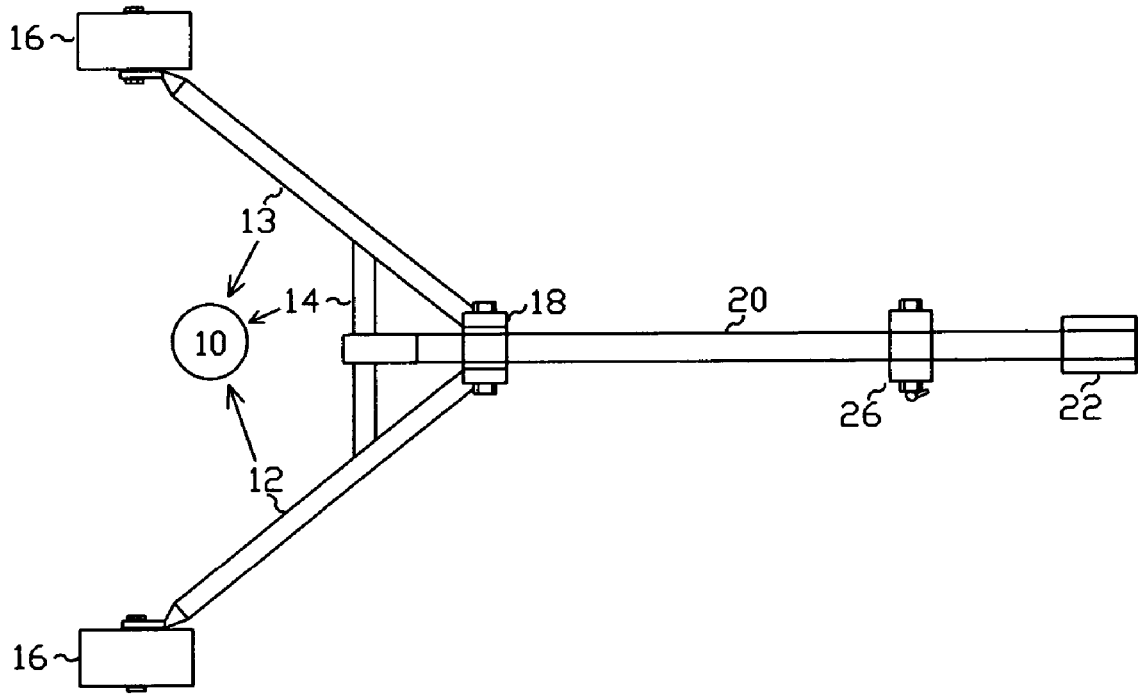
FIG. 6 is a top view of the portable workstation apparatus with the seat and work surface removed for frame assembly clarity.
Figure 7:
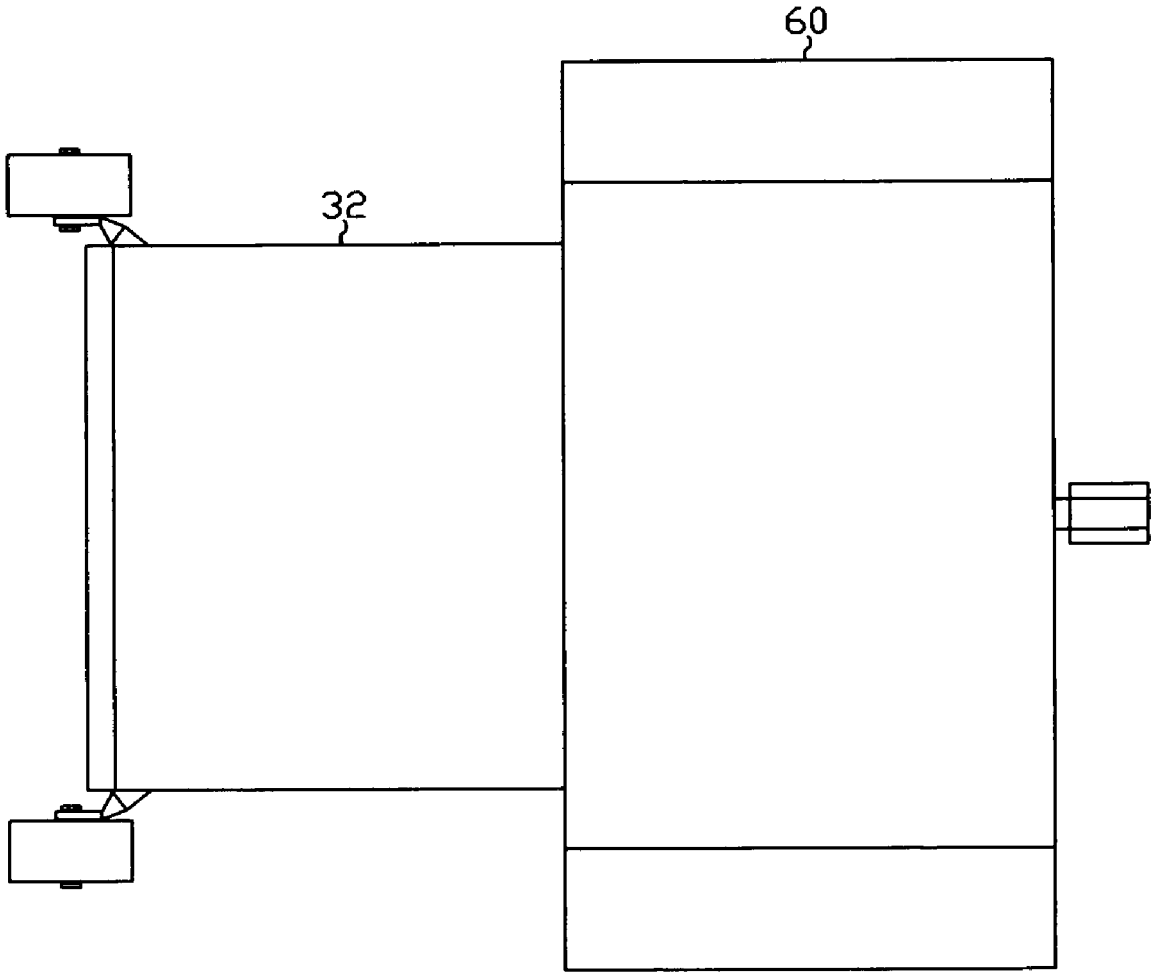
FIG. 7 is a top view of the portable workstation apparatus.

FIG. 6 is a top view of the portable workstation apparatus with the seat and work surface removed for frame assembly clarity. The Frame 10 is comprised of a first frame member 12, a mirror image frame member 13, and a stiffening member 14, forming an a first frame subassembly. The wheels 16 are also shown located at frame member 12 and 13 endpoints. The Joint 18 is shown cooperating with Frame 10 and Frame 20, with stiffening member 14 providing a mechanical stop to the Frame assembly in the collapsed transport and storage position FIG. 7 is a top view of the portable workstation apparatus depicting the seat 32 and work surface 60.

Figure 8:
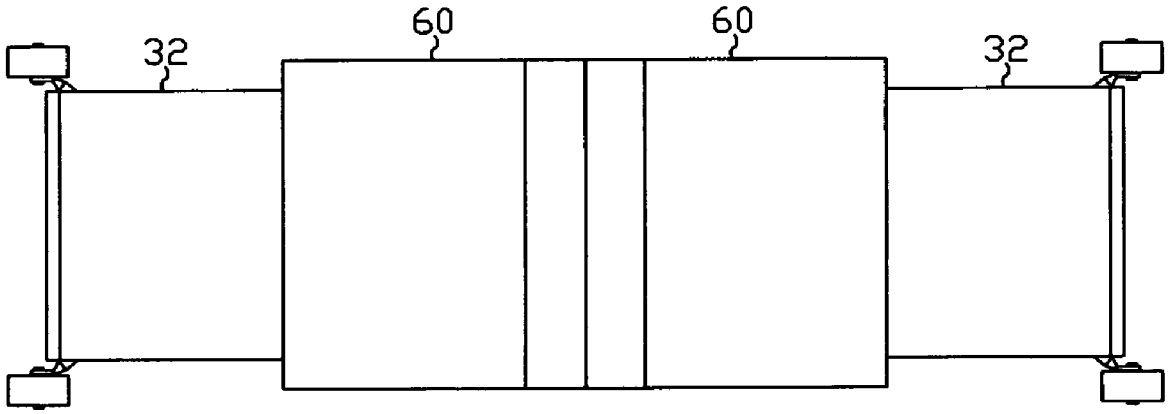
FIG. 8 is a top view of the multiple portable workstation apparatuses depicting a cooperative work surface area.

FIG. 8 is a top view of multiple portable workstation apparatuses depicting a cooperative work surface areas 60 and seats 32.

We claim:

1. A portable workstation, comprising:

a. means for providing portability including an articulated and collapsible tripod frame assembly and wheels on said articulated and collapsible tripod frame assembly;

b. means for supporting personnel comprising a scissors linkage lift mechanism; and c. means for supporting work equipment.

2. A portable workstation as recited in claim 1, wherein said articulated and collapsible tripod frame assembly includes:

a. a first frame subassembly;

(a). said first frame subassembly generally comprised of two or more members including a first frame member, a second frame member, and a stiffening member;

(b). said first frame member, said second frame member, and said stiffening member existing in a common plane; said first frame member having one endpoint generally converging with one endpoint of said second frame member; said first frame member having remaining endpoint diverging from remaining endpoint of said second frame member; said stiffening member cooperating with said first and second frame members forming said first frame subassembly;

(c). said first frame subassembly essentially forming two members of said articulated and collapsible tripod frame assembly;

(d). a wheel assembly cooperating near each said first frame subassembly diverging endpoints;

b. a second frame subassembly;

said second frame subassembly formed from a beam type structure of one or more components;

(a). a wheel assembly cooperating near an endpoint of said second frame subassembly;

(b). a handle formed within or alternately a handle cooperating with said second frame subassembly, said handle generally located adjacent to said wheel assembly;

c. optionally said first and second frame subassemblies having attachment devices as a means to anchor said workstation to inhibit unintended motion;

d. optionally said first and second frame subassemblies having attachment devices as a means to aid transport or storage of said workstation; and e. said portable workstation being constructed of various materials to cooperate with work area environmental conditions.

3. A portable workstation as recited in claim 2, wherein said means for supporting personnel includes a seat assembly.

4. A portable workstation as recited in claim 3, wherein said seat assembly includes:

a. a seat; and b. a seat assembly mounting device cooperating with said articulated and collapsible tripod frame assembly.

5. A portable workstation as recited in claim 4, wherein said scissors linkage lift mechanism:

a. provides a seat vertical position control device;

b. said scissors linkage lift mechanism optionally employing pinch point guarding and aesthetic covering(s);

c. said scissors linkage lift mechanism having an operative handle;

d. said operative handle comprised of one or more components; and e. said operative handle optionally having one or more components articulated.

6. A portable workstation as recited in claim 4, wherein said seat optionally comprises a control device to facilitate and/or prevent seat rotation about the vertical axis.

7. A portable workstation as recited in claim 4, wherein said seat optionally includes:

a. ergonomic design shapes, features, and or profiles to include flat, round, polygonal, contoured, articulated, ventilated, and any combination thereof;

b. being replaceable; and c. being constructed of various materials to cooperate with work area environmental conditions.

8. A portable workstation as recited in claim 4, wherein said seat optionally includes:

a. having a seat back support;

b. said seat back support being removable from said seat;

c. said seat back support being articulated with respect to said seat;

d. said seat back support having a seat back;

e. seat back having ergonomic design shapes and profiles to include flat, round, polygonal, contoured, articulated, ventilated, and any combination thereof;

f. seat back being replaceable;

g. seat back being constructed of various materials to cooperate with work area environmental conditions.

9. A portable workstation as recited in claim 2, wherein said means for supporting work equipment includes a work surface assembly.

10. A portable workstation as recited in claim 9, wherein said work surface assembly includes:

a. a work surface providing a work area;

b. said work surface being an approximate planar surface;

c. a work surface position control device, generally comprising one or more extensible members;

d. said work surface position control device having a lockable articulated cooperation with said second frame subassembly, f. said work surface position control device having a lockable articulated cooperation with said work surface;

g. said work surface optionally having one or more attachment areas for lockable articulated cooperation with said work surface position control device; and h. said work surface assembly being constructed of various materials to cooperate with work area environmental conditions.

11. A portable workstation as recited in claim 10, wherein:

a. said work surface position control device extensible members' articulated cooperation with said second frame subassembly and said work surface provides means of horizontal and vertical positioning of said work surface with respect to said seat.

12. A portable workstation as recited in claim 11, wherein:

a. said work surface being positionable about the horizontal plane; and b. said positioning providing means to emulate an easel.

13. A portable workstation as recited in claim 10, wherein:

a. said work surface work area being adjustable via articulated extensions, sliding extensions, and/or complete said work surface replacement with alternate work surface;

b. said work surface and/or alternate work surface optionally supported via auxiliary support members;

c. said auxiliary support members cooperating with various articulated and collapsible tripod frame subassemblies;

d. said work surface comprised of continuous or articulated stock, processed by cutting, bending, forming, casting, or molding;

e. said stock including necessary stiffening members or features fixed about said work surface underside via cutting, bending, forming, casting, or molding; and f. said stiffening members providing rigidity to said work surface.

14. A portable workstation as recited in claim 10, wherein:

a. said work surface having a member formed essentially perpendicular to said work surface forming a hand truck nose;

b. said hand truck nose being articulated, providing increased work surface work area;

c. said work surface optionally having at least one or more holes formed therein; and d. said workstation, in said collapsed form, forming a hand truck; and e. said hand truck having means to transport equipment.

15. A portable workstation as recited in claim 10, wherein:

a. said work surface being replaceable with an equipment mounting means;

b. said equipment mounting means having a lockable articulated cooperation with said work surface position control device; and c. said equipment mounting means interchangeable to optionally include male thread pipe nipple or female thread pipe coupling or photographic equipment mounting means.

16. A portable workstation as recited in claim 2, wherein said articulated and collapsible tripod frame assembly includes cooperation between said first frame subassembly's said first and second frame members' converging endpoints, providing a point of articulation with said second frame subassembly, forming said articulated and collapsible tripod frame assembly.

17. A portable workstation as recited in claim 16, wherein:

a. said point of articulation may be at any point about said first frame subassembly; and b. said point of articulation may be at any point about said second frame subassembly.

18. A portable workstation as recited in claim 17, wherein said articulated and collapsible tripod frame assembly includes a symmetrical or an asymmetrical configuration, wherein said first frame subassembly and said second frame subassembly may be equal or unequal in measured lengths.

19. A portable workstation as recited in claim 18, wherein said articulated and collapsible tripod frame assembly includes a means to position said articulated and collapsible tripod frame assembly in an upright operating position and a collapsed transport and storage position.

20. A portable workstation as recited in claim 19, wherein said articulated and collapsible tripod frame assembly includes:

a. a supporting member cooperating with said first frame subassembly and second frame subassembly of articulated and collapsible tripod frame assembly;

b. the cooperation of said supporting member and said articulated and collapsible tripod frame assembly, positioning said articulated and collapsible tripod frame assembly in an upright operating position;

c. the release of the cooperation of said supporting member from said articulated and collapsible tripod frame assembly from either said first frame subassembly or second frame subassembly allowing positioning of said articulated and collapsible tripod frame assembly into a collapsed transport and storage position; and optionally;

d. said first frame subassembly stiffening member cooperating as a mechanical stop with said second frame subassembly.

21. A portable workstation as recited in claim 19, wherein said articulated and collapsible tripod frame assembly includes:

a. a locking articulation device cooperating with said first frame subassembly generally near the point of articulation and said second frame subassembly;

b. locking of said locking articulation device positioning said articulated and collapsible tripod frame assembly in an upright operating position;

c. release of said locking articulation device allowing positioning of said articulated and collapsible tripod frame assembly into a collapsed transport and storage position; and optionally;

d. said first frame subassembly stiffening member cooperating as a mechanical stop with said second frame subassembly.

22. A portable workstation as recited in claim 1, wherein said wheels to optionally include one or more of the following characteristics:

a. sufficient widths to resist sinking in soft surfaces including water laden soils;

b. having sufficient widths to resist entrance into traffic grating grid openings;

c. having means to facilitate and/or inhibit motion;

d. having means to facilitate said workstation leveling; and e. being constructed of various materials to cooperate with work area environmental conditions.

23. A portable workstation as recited in claim 1, wherein said articulated and collapsible tripod frame assembly optionally includes replacing one or more wheels with a skid plate assembly.

24. A portable workstation as recited in claim 23, wherein said skid plate assembly to optionally include one or more of the following characteristics:

a. an approximate planar surface;

b. said planar surface having sufficient area to resist sinking in soft surfaces including water laden soils;

c. said planar surface having sufficient area to resist entrance into traffic grating grid openings;

d. having means to facilitate or inhibit motion;

e. having means to facilitate said portable workstation leveling; and f. being constructed of various materials to cooperate with work area environmental conditions.

25. A portable workstation, comprising:

a. means for supporting personnel comprising a scissors linkage lift mechanism;

b. means for supporting work equipment;

c. means for providing portability including an articulated and collapsible tripod frame assembly and wheels on said articulated and collapsible tripod frame assembly; and d. means for transporting said work equipment.

26. A portable workstation, comprising:

a. means for supporting personnel comprising a scissors linkage lift mechanism;

b. means for supporting work equipment;

c. means for providing portability including an articulated and collapsible tripod frame assembly and wheels on said articulated and collapsible tripod frame assembly; and d. means for providing cooperation among two or more workstations, across, side by side and any combination thereof to provide a cooperative work surface work area and cooperative seating areas.

27. A portable workstation, comprising:

a. an articulated and collapsible tripod frame assembly;

b. said articulated and collapsible tripod frame assembly comprising a first frame subassembly, a second frame subassembly; a handle on said second frame subassembly, means to position said articulated and collapsible tripod assembly in an upright operating position and a collapsed transport and storage position;

c. wheels on said articulated and collapsible tripod frame assembly providing means for portability;

d. a seat assembly, cooperating with said articulated and collapsible tripod frame assembly, said seat assembly generally comprising a seat, a seat vertical position control device comprising a scissors linkage lift mechanism, providing means for supporting personnel;

e. a work surface assembly, cooperating with said articulated and collapsible tripod frame assembly, said work surface being generally a planar surface;

f. a work surface position control device, generally comprising one or more extensible members, said work surface position control device having a lockable articulated cooperation with said second frame subassembly, said work surface position control device having a lockable articulated cooperation with said work surface;

g. said work surface optionally having one or more attachment areas for lockable articulated cooperation with said work surface position control device; said work surface position control device and said means of horizontal and vertical positioning of said work surface with respect to said seat providing means for supporting equipment;

h. said work surface having an articulated member cooperating within a common plane with said work surface providing an increased work surface work area, or alternately said articulated member cooperating generally perpendicular with said work surface work area forming a hand truck nose;

i. said work surface, optionally having at least one or more holes formed therein; and j. said workstation, in said collapsed transport and storage position, and said work surface forming said hand truck nose, forming a hand truck, said hand truck providing means to transport equipment.

28. A method of providing a portable workstation, comprising the steps of:

a. providing portability including an articulated and collapsible tripod frame assembly and wheels on said articulated and collapsible tripod frame assembly;

b. supporting personnel comprising a scissors linkage lift mechanism; and c. supporting work equipment.

29. A method of providing a portable workstation, comprising the steps of:

a. supporting personnel comprising a scissors linkage lift mechanism;

b. supporting work equipment;

c. providing portability including an articulated and collapsible tripod frame assembly and wheels on said articulated and collapsible tripod frame assembly; and d. transporting said work equipment.

30. A method of providing a portable workstation, comprising the steps of:

a. supporting personnel comprising a scissors linkage lift mechanism;

b. supporting work equipment; and c. providing portability including an articulated and collapsible tripod frame assembly and wheels on said articulated and collapsible tripod frame assembly; and providing cooperation among two or more workstations, across, side by side or any combination thereof to provide a cooperative work surface area and seating areas.

31. A method of providing a portable workstation, comprising the steps of:

a. providing an articulated and collapsible tripod frame assembly;

b. providing means to position said articulated and collapsible tripod frame assembly in an upright operating position and a collapsed transport and storage position;

c. providing wheels on said articulated and collapsible tripod frame assembly providing means for portability;

d. providing a seat assembly cooperating with said articulated and collapsible tripod frame assembly;

f. providing a seat assembly vertical position control device comprising a scissors linkage lift mechanism;

g. providing cooperation between said seat assembly vertical position control device and said seat assembly and said articulated and collapsible tripod frame assembly providing means for supporting personnel;

h. providing a work surface;

i. providing a work surface position control device;

j. providing lockable articulated cooperation between said work surface and said work surface position control device and said articulated and collapsible tripod frame assembly;

k. providing said work surface, optionally with one or more attachment areas for lockable articulated cooperation with said work surface position control device;

l. providing means of horizontal and vertical positioning of said work surface with respect to said seat assembly providing means for supporting equipment;

m. providing a work surface having an articulated member cooperating within a common plane with said work surface providing an increased work surface work area, or alternately said articulated member cooperating generally perpendicular with said work surface work area forming a hand truck nose;

o. providing said work surface, optionally having at least one or more holes formed therein; and p. providing said workstation, in said collapsed transport and storage position, and said work surface forming said hand truck nose, forming a hand truck, said hand truck providing means to transport equipment.

32. A portable workstation, comprising:

a. means for supporting personnel;

b. means for supporting work equipment;

c. means for providing portability including an articulated and collapsible tripod frame assembly and wheels on said articulated and collapsible tripod frame assembly;

d. means for transporting said work equipment: and e. means for collapsing said workstation and forming a portable hand truck.

33. A portable workstation, comprising:

a. an articulated and collapsible tripod frame assembly;

b. said articulated and collapsible tripod frame assembly comprising a first frame subassembly, a second frame subassembly; a handle on said second frame subassembly, means to position said articulated and collapsible tripod frame assembly in an upright operating position and a collapsed transport and storage position; and c. wheels on said articulated and collapsible tripod frame assembly providing means for portability;

d. a seat assembly, cooperating with said articulated and collapsible tripod frame assembly, said seat assembly generally comprising a seat, an optional seat vertical position control device providing means for supporting personnel;

e. a work surface assembly, cooperating with said articulated and collapsible tripod frame assembly, said work surface being generally a planar surface;

f. a work surface position control device, generally comprising one or more extensible members, said work surface position control device having a lockable articulated cooperation with said second frame subassembly, said work surface position control device having a lockable articulated cooperation with said work surface; and g. said work surface optionally having one or more attachment areas for lockable articulated cooperation with said work surface position control device; said work surface position control device and said means of horizontal and vertical positioning of said work surface with respect to said seat providing means for supporting equipment;

h. said work surface having an articulated member cooperating within a common plane with said work surface providing an increased work surface work area, or alternately said articulated member cooperating generally perpendicular with said work surface work area forming a hand truck nose;

i. said work surface, optionally having at least one or more holes formed therein; and j. said workstation, in said collapsed transport and storage position, and said work surface forming said hand truck nose, forming a hand truck, said hand truck providing means to transport equipment.

34. A method of providing a portable workstation, comprising the steps of:

a. providing an articulated and collapsible tripod frame assembly;

b. providing means to position said articulated and collapsible tripod frame assembly in an upright operating position and a collapsed transport and storage position;

c. providing wheels on said articulated and collapsible tripod frame assembly providing means for portability;

d. providing a seat assembly cooperating with said articulated and collapsible tripod frame assembly, providing means for supporting personnel;

g. providing a work surface;

h. providing a work surface position control device;

i. providing lockable articulated cooperation between said work surface and said work surface position control device and said articulated and collapsible tripod frame assembly;

j. providing said work surface, optionally with one or more attachment areas for lockable articulated cooperation with said work surface position control device;

k. providing means of horizontal and vertical positioning of said work surface with respect to said seat, providing means for supporting equipment;

l. providing a work surface having an articulated member cooperating within a common plane with said work surface providing an increased work surface work area, or alternately said articulated member cooperating generally perpendicular with said work surface work area forming a hand truck nose;

m. providing said work surface, optionally having at least one or more holes formed therein; and n. providing said workstation, in said collapsed transport and storage position, and said work surface forming said hand truck nose, forming a hand truck, said hand truck providing means to transport equipment.

* * * * *